US006609853B1

(12) United States Patent
Guilmette

(10) Patent No.: US 6,609,853 B1
(45) Date of Patent: Aug. 26, 2003

(54) SPILLAGE RECOVERY DEVICE AND METHOD OF USE

(76) Inventor: Paul Guilmette, P.O. Box 13, Canton Center, CT (US) 06020

( * ) Notice: Subject to any disclaimer, the term of this patent is extended or adjusted under 35 U.S.C. 154(b) by 0 days.

(21) Appl. No.: 09/644,413

(22) Filed: Aug. 23, 2000

(51) Int. Cl.[7] ..... E02B 15/04

(52) U.S. Cl. ..... 405/67; 405/60; 405/63; 405/66; 405/68; 210/922

(58) Field of Search ..... 405/60, 63, 64, 405/66, 67, 68; 210/242.3, 922

(56) References Cited

U.S. PATENT DOCUMENTS

| | | | | | |
|---|---|---|---|---|---|
| 3,664,136 | A | | 5/1972 | Laval, Jr. et al. | 61/1 |
| 3,838,836 | A | | 10/1974 | Asseo et al. | 244/137 R |
| 3,844,941 | A | | 10/1974 | Jones | 210/40 |
| 3,943,720 | A | * | 3/1976 | Milgram | 405/63 |
| 4,047,390 | A | | 9/1977 | Boyce, II | 61/69 R |
| 4,308,006 | A | | 12/1981 | Koblanski | 431/1 |
| 4,318,442 | A | | 3/1982 | Lunde et al. | 166/357 |
| 4,691,661 | A | * | 9/1987 | Deiana | 114/267 |
| 4,735,524 | A | * | 4/1988 | Dunkers | 405/63 |
| 5,009,041 | A | | 4/1991 | Fly | 52/2.19 |
| 5,197,821 | A | | 3/1993 | Cain et al. | 405/68 |
| 5,310,283 | A | * | 5/1994 | Berg | 405/67 |
| 5,385,427 | A | * | 1/1995 | Kateley et al. | 405/68 |
| 5,407,301 | A | * | 4/1995 | Lydiard et al. | 405/66 |
| 5,465,925 | A | | 11/1995 | Connolly et al. | 244/137.1 |
| 5,470,467 | A | | 11/1995 | Soule | 210/242.3 |
| 5,575,586 | A | * | 11/1996 | Lydiard et al. | 405/66 |
| 5,577,687 | A | | 11/1996 | Downing | 244/110 E |
| 5,788,186 | A | | 8/1998 | White | 244/137.4 |
| 5,927,649 | A | | 7/1999 | Nykiforuk | 244/118.1 |
| 6,089,789 | A | * | 7/2000 | Santamaria | 405/63 |

* cited by examiner

*Primary Examiner*—Gary S. Hartmann

(57) ABSTRACT

A recovery device (10) for containing a material (16) floating on the surface of a liquid (12) comprises a shroud (26) having an open top and an open bottom, the top being of smaller diameter than the bottom, thus forming a truncated cone-like shape. The open top has an open area which is smaller than the area of the open bottom. The device (10) is positioned with the open bottom above the surface of the liquid (12) and encircling at least a portion of the floating material (16). It is then allowed to sink to its collection position, in which the open bottom is submerged below, and the open top is at or above, the surface of the liquid (12). As a result, the floating material (16) is encircled by the open bottom and is forced into the smaller area of the open top as the device (10) sinks into the water. The recovery device (10) may include a collar (24) attached to the open top, a skirt (28) attached to the open bottom and ballast weights (38) to aid in sinking the device (10).

17 Claims, 5 Drawing Sheets

SPILLAGE RECOVERY DEVICE AND METHOD OF USE

BACKGROUND OF THE INVENTION

1. Field of the Invention

The present invention concerns a spillage recovery device and its method of use and, in particular, relates to the recovery of oil spills upon water.

2. Related Art

Although the present invention can be used to recover any floating material upon water, it is particularly well-suited to the recovery of oil spills on water. Oil spillage can result from several sources such as accidental discharge from ships, run-off from land, shipwrecks, oil well blowouts, and the like. The conventional method of recovery of oil spillage on the water is the use of a boom curtain that is deployed around the oil spill. The curtain is stored in a folded condition and upon deployment, a flotation collar is inflated and then the curtain is pulled around the oil spill. Such a boom curtain is disclosed in U.S. Pat. No. 5,197,821, issued to Cain et al on Mar. 30, 1993 and entitled "Lightweight, Rapid Deployment Oil Spill Containment Boom". A suction system removes the oil after it is confined to an area within the boom and the recovered oil is placed in a storage container. The confined oil can also be treated with sulfur which tends to hold the oil together so that it can be collected by a system having scoops as disclosed in U.S. Pat. No. 3,844,941, issued to Jones on Oct. 29, 1974 and entitled "Use of Sulfur for Combatting Oil Spills". Another major source of oil spillage is oil well blowouts. Both U.S. Pat. No. 3,664,136, issued to Laval, Jr., et al on May 23, 1972 and entitled "Collecting Device for Submarine Oil Leakage", and U.S. Pat. No. 4,318,442, issued to Lunde et al on Mar. 9, 1982 and entitled "Method and Apparatus for Controlling an Underwater Well Blowout", disclose systems for collecting oil leaking from underwater sources.

The aforementioned U.S. Pat. No. 5,197,821 discloses a boom curtain having a flotation chamber and a ballast chamber with a curtain connecting therebetween. The boom curtain can be deployed by means of an airplane, helicopter, or ship. Upon deployment, the flotation chamber is inflated by compressed air bottles and/or other compressed air sources. The ballast chamber fills with water.

U.S. Pat. No. 3,844,941 discussed above discloses a system of collecting oil from an oil spill where sulfur powder or hot sulfur is sprayed on the oil spill and acts to entrap the oil. The oil can then be collected by a mechanical scoop. The sulfur can be applied to the oil spill by helicopter or ship which is the preferred method because of its large capacity for storage.

U.S. Pat. No. 4,318,442 discussed above discloses an apparatus that is lowered over an underwater oil well blowout having both gas and oil therein. A cylindrical hollow body has a base ring as ballast. The top of the body is attached to a frusto-conical top with a chimney thereon. Vent ports in the side of the body allow water to move in and out as the volume of gas changes in the top. The gas is removed from the top by means of a conduit and can just be vented or recovered. The body has an oil outlet located in the oil layer therein and the oil can be removed by pump to a storage container located on a ship. The apparatus is lowered by crane to the site of the oil well.

U.S. Pat. No. 3,664,136 discussed above discloses another device for collecting oil leaking from underwater. A pair of ring-shaped envelopes provides a container for holding a ballast material that keeps the device located about the source of oil. A frusto-conical shaped shroud is connected to the envelopes. The upper part of the shroud has a smaller envelope thereabout to provide a desired form to the device. An oil removal conduit is located at the top of the shroud.

Although these devices do provide a means for collecting oil, they do not provide a means for immediately reducing the area of the oil spill and collecting the oil therein.

SUMMARY OF THE INVENTION

In one broad aspect, the present invention relates to a recovery device for containing a material floating on the surface of a liquid. The recovery device includes a shroud having an open top and an open bottom, the open top having an area which is smaller than the area of the open bottom. The device being of sufficient weight causes the shroud to sink in the liquid such as water to a collection position in which the open bottom is submerged below, and the open top is at or above, the surface of the liquid. The device is positioned with the open bottom at the surface of the liquid and encircling at least a portion of the floating material and then the shroud is allowed to sink to its collection position collecting the floating material encircled by the open bottom into the smaller area of the open top, thereby facilitating collection of the floating material.

According to another aspect of the invention, the recovery device may also include a collar attached to the open top, a skirt attached to the open bottom and ballast weights to further aid in sinking the shroud about the floating material. The collar provides an attachment point between the shroud and a deployment carrier, such as a ship or helicopter, and also provides an area to collect the floating material. The skirt may provide stiffness to the open bottom and as an attachment point for the ballast weights. The recovery device is transported to a location of the floating material to be collected and the open bottom is then lowered over at least a portion of the floating material and as it sinks, the floating material is forced into the smaller area of the open top where it is collected.

In accordance with another aspect of the invention, the recovery device for containing floating material such as oil on a water surface has a releasable holding device connected to the collar and to a deployment carrier when in use. The releasable holding device is connected to the recovery device which has a shroud with an open area in the open top where the floating material is collected. The flexible shroud is essentially a truncated cone with an open top and an open bottom. The shroud provides a solid flexible wall between the open top and the open bottom. A skirt is connected to the bottom of the shroud and an expandable device is connected to the skirt. In a transport mode, the shroud may be essentially cylindrical in shape and, after the expandable device operates on the skirt, the skirt opens to have an open area therein of substantially greater area than the open area of the collar. In order to force the floating material into the collar open area, ballast weights are attached about the skirt and the ballast is of sufficient weight so as to cause the skirt to sink in the water about the floating material whereby the floating material in the skirt open area is reduced from such area to the collar open area of substantially less size for collecting the floating material therefrom.

Yet another aspect of the present invention provides a recovery device that may be a frustum-shaped shroud although the bottom may be circular or polygonal in shape and the top is attached to a collar having an open top.

Still another aspect of the present invention provides a recovery device that collects a large diameter of spillage and reduces it to a much smaller diameter for recovery.

The present invention may also provide a recovery device that may be repeatedly used.

These and many other objects and advantages of the present invention will be readily apparent to one skilled in the pertinent art from the following detailed description of a preferred embodiment of the invention and the related drawings.

DETAILED DESCRIPTION OF THE INVENTION AND PREFERRED EMBODIMENTS THEREOF

Figure 1:
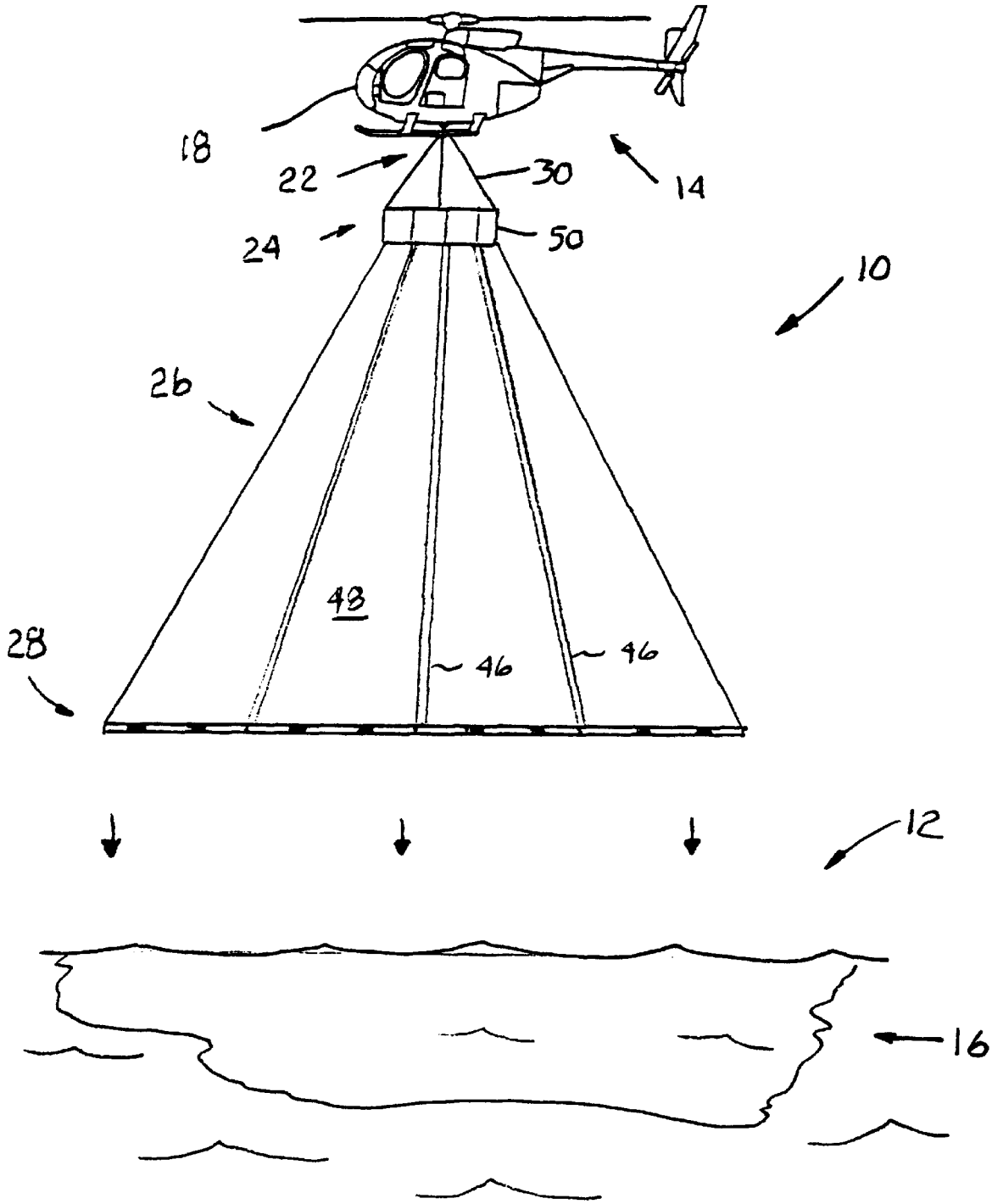
FIG. 1 is a side view of a recovery device being deployed by helicopter over a water spillage.

Referring to FIG. 1, a recovery device 10 is shown removably attached under a transport carrier 14. The recovery device 10 is being positioned over a body of water 12 having a floating material 16 thereon. The floating material 16 may be oil from a spillage.

Figure 3:
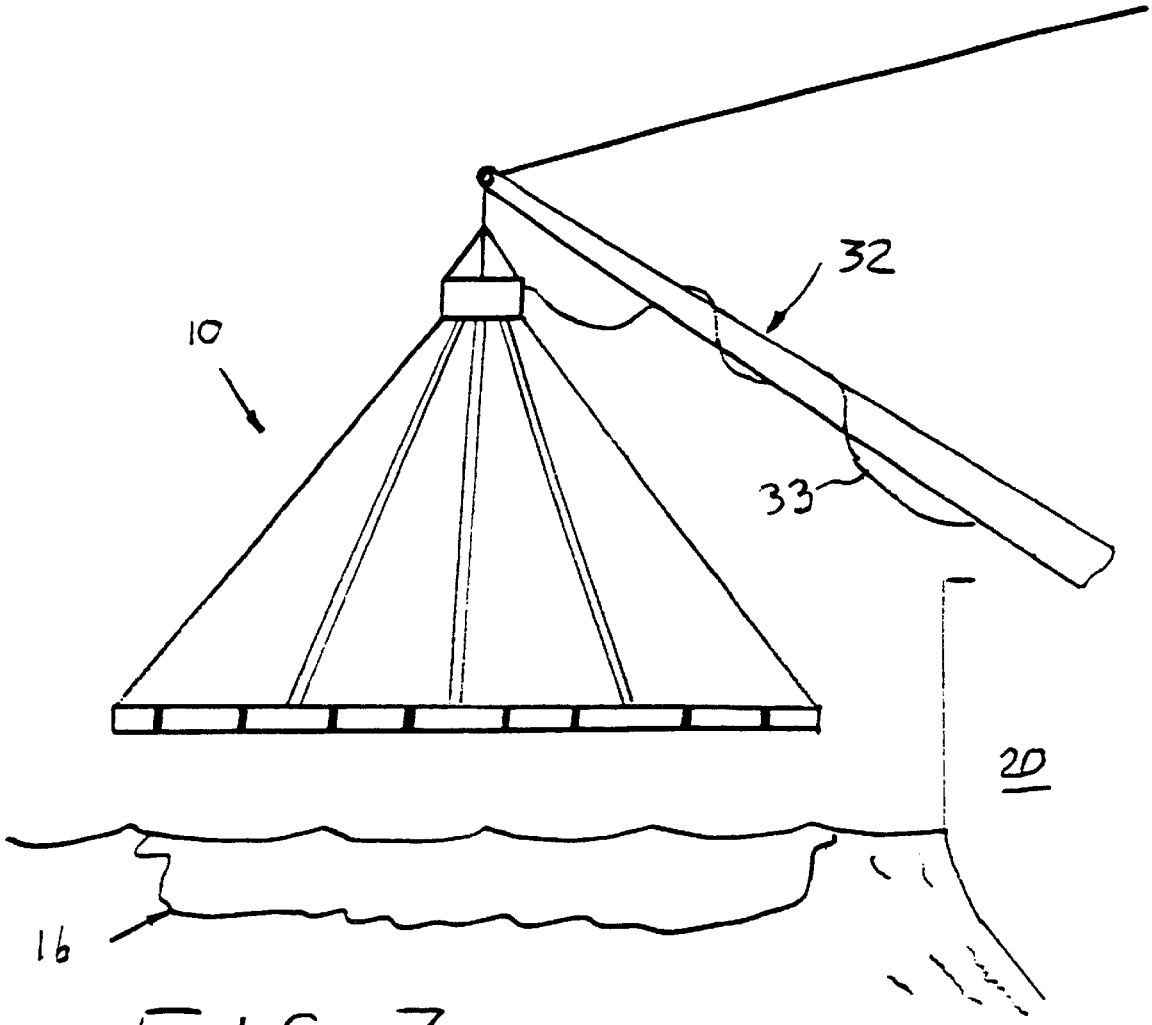
FIG. 3 is a side view of the recovery device of FIG. 1 being deployed by ship.

The transport carrier 14 may be a hovering aircraft such as the helicopter 18 or a ship 20, FIG. 3. As can be seen, the recovery device 10 presents a significant wind cross section and this may greatly affect the performance of the helicopter 18. Even in a non-deployed state, the recovery device 10 still presents a significant wind cross section. There are clearly different sizes of helicopters that can be used that range from a small two seat helicopter to a larger transport helicopter. The problems of carrying a load like this by a helicopter are well recognized and have been addressed in many patents such as U.S. Pat. No. 5,465,925 which addresses the release of the load under certain defined conditions. U.S. Pat. No. 3,838,836 addressed a three-point suspension system for carrying loads by heavy lift helicopters. U.S. Pat. No. 5,788,186 addresses the problem of stabilizing loads by use of an apparatus attached to the bottom of the helicopter. The above patents are incorporated herein by reference.

Figure 2:
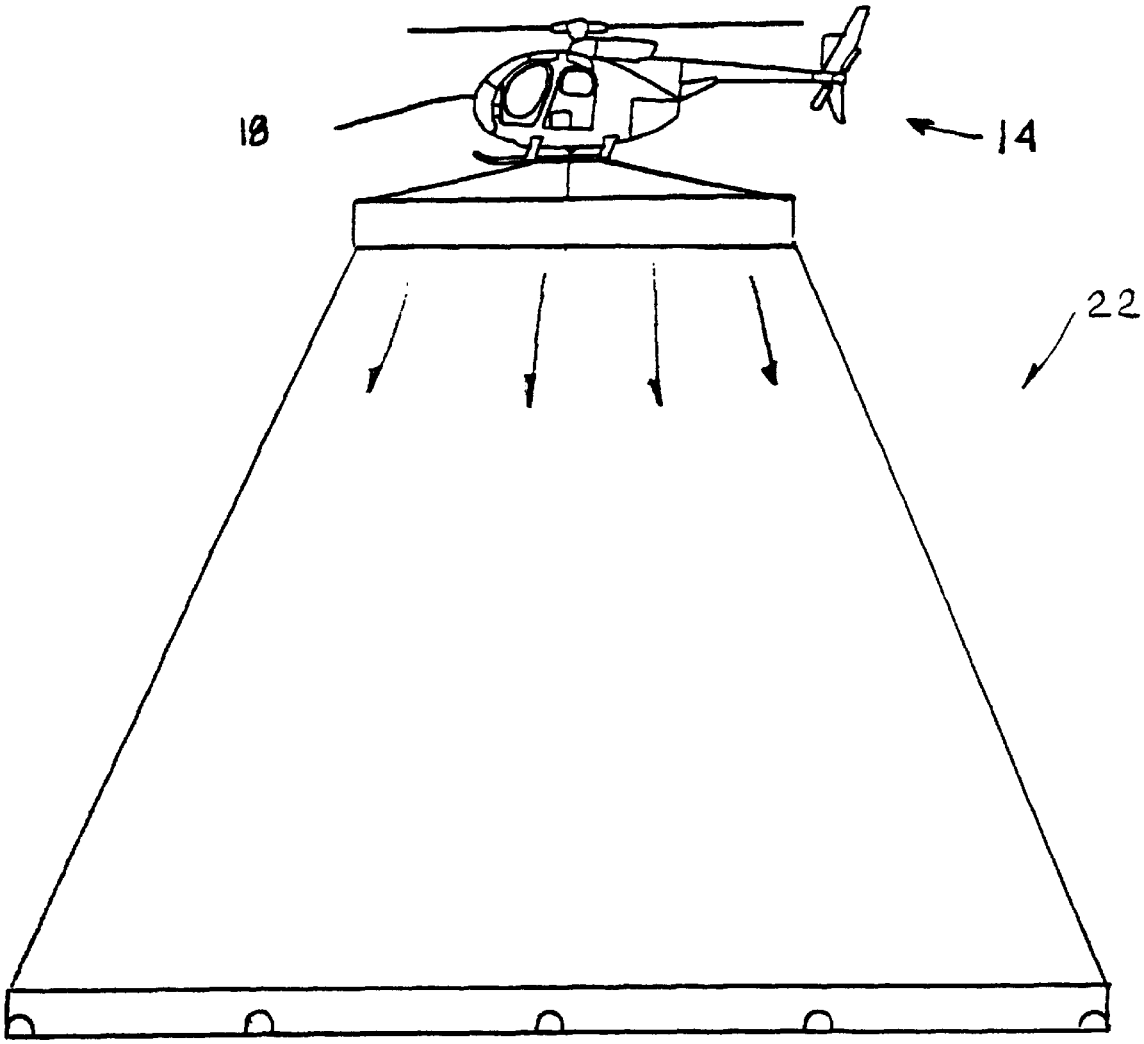
FIG. 2 is a side view of the recovery device of FIG. 1 having larger diameter openings.

FIG. 2 illustrates a larger releasable holding device 22 where the downwash of the helicopter 18 inflates the releasable holding device 22.

A ship 20, FIG. 3, may deploy the recovery device 10 with the use of a crane 32. This method of use allows for repeated deployments as long as the ship can approach the floating material 16. After the recovery device 10 is lowered onto the floating material 16 by a cable from the ship 20, the floating material 16 within the collar is collected through a hose 33 and placed within a storage container on the ship 20.

Figure 4:
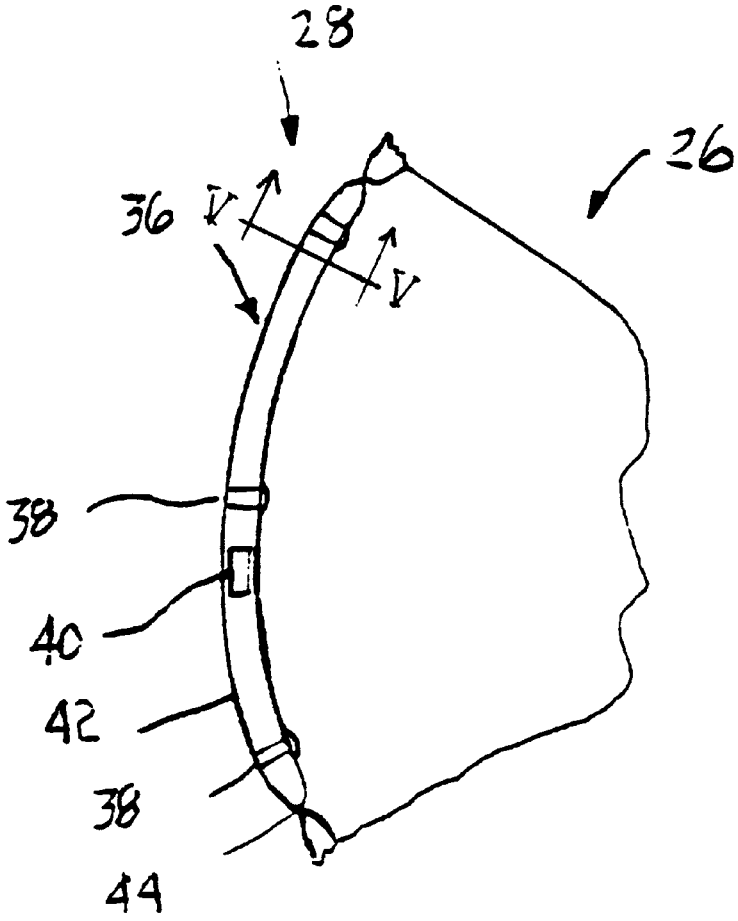
FIG. 4 is a partial top view of the recovery device of FIG. 1 having a skirt with ballast weights thereon.
Figure 5:
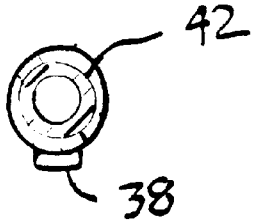
FIG. 5 is a partial cross-sectional view taken along line V—V of FIG. 4.

Referring to FIG. 4, a top partial view of an expandable device 36 is shown. A skirt 28 may be composed of a plurality of identical sections 42 which may be of tubular design and made of a heavy duty plastic material similar to that of a shroud 26. An inflation device 40 is attached to each section 42 and at the deployment of the recovery device 10, the inflation devices 40 inflate each section 42 to a pressure sufficient to maintain the sections 42 in a predetermined shape. The manner of inflating such sections is shown in U.S. Pat. No. 5,197,821, which is incorporated herein by reference. Each section 42 is connected to an adjacent section 42 at flexible joints 44. A plurality of ballast weights 38 that may be strapped about section 42 to ease storage and transport of the recovery device 10 until actual deployment. FIG. 5 illustrates by cross section the tubular section 42 having a ballast weight 38 strapped thereon. Referring back to FIG. 1, a releasable holding device 22 connects the recovery device 10 to the helicopter 18 in the manner already disclosed herein. A plurality of cables 30 are attached between the control device, not shown, and a collar 24. The cables 30 may be joined as one cable or as several. The lower part of the cables 30 are attached to the collar 24 and the collar 24 has an essentially cylindrical shape with an open area inside for collecting the floating material 16.

Referring to FIG. 1, the shroud 26 is connected between the collar 24 and the skirt 28 and forms a frustum-shaped structure with a solid wall thereabout. The shroud 26 may be constructed of single-ply or multiple-ply plastic sheeting or other synthetic sheet material which must be resistant to the chemicals in the floating material 16. To further strengthen the shroud 26, a plurality of ribs 46 may be attached to the shroud wall 48 in numerous patterns, but only vertical ribs are shown in FIG. 1. The ribs 46 may be hollow and similarly constructed as the expandable device 36 and inflated along with other expandable device 36. The ribs 46 would further prevent undesired oscillations between the skirt 28 and the collar 24 in winding environments.

The collar 24 may be of one-piece construction but this would make transportation, as well as storage, difficult. Referring to FIG. 1, the collar 24 is shown having a polygonal shape of several collar sections 50.

Figure 6:
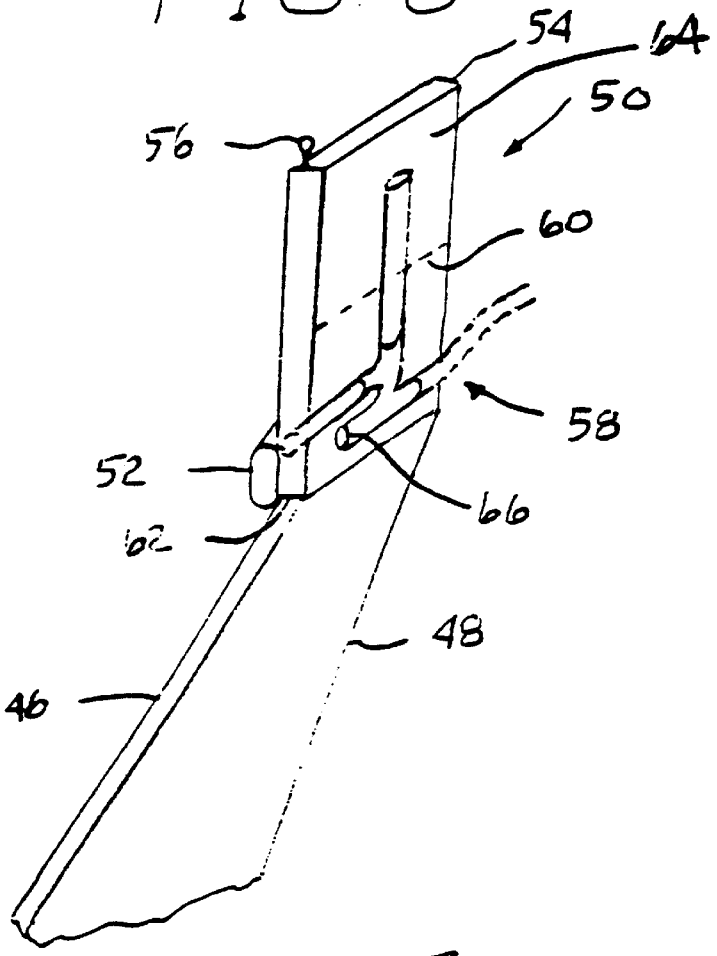
FIG. 6 is a partial view of one embodiment of the present invention showing a collar having a flotation device and a collection system thereon.

In FIG. 6, only one section 50 of collar 24 is shown. The shroud wall 48 is attached to bottom 62 of section 50, which is essentially rectangular in shape and is made of a strong, lightweight material so that it may stand alone. An eyelet 56 is attached to top edge 54 of section 50. Although section 50 may be buoyant in itself, a flotation device 52 may be attached to a bottom 62 of section 50. The floating material 16 (FIGS. 1 and 7) collected within the collar 24 may be directly removed with hoses, for example, hose placed in the material 16. Section 50 may, however, include a fluid recovery manifold 58 attached to the inside wall 64 of collar 24, the manifold 58 having inputs 66 for removing the floating material 16 from collar 24. Outside hoses would be attached to the manifold 58 for transferring the material to, for example, a storage container on a ship. The inputs 66 are positioned so that when device 10 is deployed in its collection position in the water, inputs 66 of manifold 58 will be under the surface 60 of the floating material 16.

Figure 7:
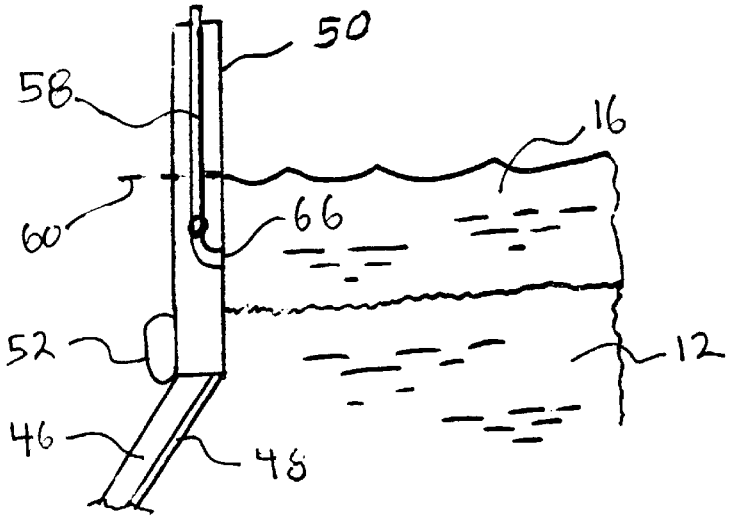
FIG. 7 is a cross-sectional view showing a collection system embedded within the collar.

FIG. 7 illustrates the manifold 58 placed within section 50 of collar 24.

While the invention has been described in detail with respect to specific preferred embodiments thereof, numerous modifications to these specific embodiments will occur to those skilled in the art upon a reading and understanding of the foregoing description; such modifications are embraced within the scope of the appended claims.

What is claimed is:

1. A recovery device for containing a material floating on the surface of a liquid, the device comprising:

a shroud having a top and a bottom and ribs, the top being of smaller diameter than the bottom, the top comprising an open top and the bottom comprising an open bottom, the open top having an open area which is smaller than the open area of the open bottom;

the device being of sufficient weight so that deployment of the device bottom-first into the liquid causes the device to sink in the liquid to a collection position in which the open bottom is submerged below, and the open top is at or above, the surface of the liquid;

whereby positioning the device with the open bottom at the surface of the liquid and over at least a portion of the floating material, and then deploying the device bottom-first into the liquid to encircle with the shroud at least a portion of the floating material and submerging the device to its collection position, forces the floating material encircled by the open bottom into the smaller area of the open top, thereby facilitating collection of the floating material.

2. The recovery device of claim 1 wherein the shroud is of a truncated conical shape.

3. The recovery device of claim 1 further including a skirt attached to the shroud at the open bottom of the shroud.

4. The recovery device of claim 3 further including an expandable device connected to the skirt, causing the skirt to have an open area therein of substantially greater area than the open top of the collar.

5. The recovery device of claim 1 further including ballast attached to the shroud.

6. The recovery device of claim 1 wherein the liquid comprises water and the floating material comprises oil.

7. The recovery device of claim 1 further including a collar disposed about the open top of the shroud.

8. The recovery device of claim 7 further including a releasable holding device comprising a plurality of cables connected to and about the collar, and the plurality of cables connected to a central support having a releasing device therein operated from a deployment carrier.

9. The recovery device of claim 7 wherein the collar is a cylindrical container of a predetermined height.

10. The recovery device of claim 9 wherein the collar further includes a flotation device thereabout to prevent the sinking of the recovery device and to further insure the retention within the collar of the collected floating material.

11. The recovery device of claim 9 wherein the collar further comprises an apparatus for collecting the floating material therein for transfer to a storage container.

12. The recovery device of claim 1 wherein the shroud has a solid wall of flexible material.

13. A method of recovering floating material from the surface of a liquid by utilizing a recovery device comprising a shroud having a top and a bottom, the top being of smaller diameter than the bottom and comprising an open top, and the bottom comprising an open bottom, the open top having an open area which is smaller than the open area of the open bottom, and the method comprising the steps of:

transporting the recovery device to a location of the floating material to be collected;

positioning the recovery device with the open bottom at the surface of the liquid and over at least a portion of the floating material;

deploying the recovery device bottom-first into the liquid to encircle with the shroud at least a portion of the floating material and sinking the device to a collection position in which the open bottom is submerged below, and the open top is at or above, the surface of the liquid to force that portion of the floating material encircled by the area of open bottom into the smaller area of the open top; inflating the shroud by a downwash of a helicopter transporting the recovery device; and collecting the floating material from the area of the open top.

14. The method of claim 13 further comprising weighting the device by providing ballast to the shroud to facilitate deployment of the device.

15. The method of claim 13 wherein the liquid comprises water and the floating material comprises oil.

16. The method of claim 13 wherein the recovery device further comprises a skirt including an expandable device and disposed about the bottom of the shroud and, prior to deployment of the device, expanding the skirt by means of the expandable device to form the open bottom of the shroud.

17. The method of claim 16 wherein the recovery device further comprises a collar disposed about the top of the shroud and comprised of a plurality of collar sections and, prior to deployment of the device, opening the sections to a polygonal configuration to form the open top of the shroud.

* * * * *